US007812536B2

(12) United States Patent
Hwang

(10) Patent No.: US 7,812,536 B2
(45) Date of Patent: Oct. 12, 2010

(54) SEALED OPPOSED DISCHARGE PLASMA DISPLAY PANEL

(75) Inventor: Eui Jeong Hwang, Youngin-si (KR)

(73) Assignee: Samsung SDI Co., Ltd., Gongse-dong, Giheung-gu, Yongin-si, Gyeonggi-do (KR)

( * ) Notice: Subject to any disclaimer, the term of this patent is extended or adjusted under 35 U.S.C. 154(b) by 796 days.

(21) Appl. No.: 11/446,377

(22) Filed: Jun. 5, 2006

(65) Prior Publication Data

US 2006/0279208 A1 Dec. 14, 2006

(30) Foreign Application Priority Data

Jun. 13, 2005 (KR) ..... 10-2005-0050245

(51) Int. Cl.
*H01J 17/49* (2006.01)

(52) U.S. Cl. ..... 313/583; 313/584; 313/292

(58) Field of Classification Search ..... 313/581–587, 313/292, 243, 268
See application file for complete search history.

(56) References Cited

U.S. PATENT DOCUMENTS

| | | | | |
|---|---|---|---|---|
| 5,541,618 | A | 7/1996 | Shinoda | |
| 5,661,500 | A | 8/1997 | Sinoda et al. | |
| 5,663,741 | A | 9/1997 | Kanazawa | |
| 5,674,553 | A | 10/1997 | Sinoda et al. | |
| 5,724,054 | A | 3/1998 | Shinoda | |
| 5,744,909 | A * | 4/1998 | Amano | 313/585 |
| 5,786,794 | A | 7/1998 | Kishi et al. | |
| 5,952,782 | A | 9/1999 | Nanto | |
| RE37,444 | E | 11/2001 | Kanazawa | |
| 6,509,689 | B1 | 1/2003 | Kim et al. | |
| 6,630,916 | B1 | 10/2003 | Shinoda | |
| 6,707,436 | B2 | 3/2004 | Setoguchi et al. | |
| 7,521,868 | B2 * | 4/2009 | Kang et al. | 313/586 |
| 2004/0075389 | A1 * | 4/2004 | Kim et al. | 313/587 |
| 2004/0145314 | A1 * | 7/2004 | Zukawa et al. | 313/582 |
| 2004/0201351 | A1 * | 10/2004 | Woo et al. | 313/582 |

(Continued)

FOREIGN PATENT DOCUMENTS

EP 0691671 A1 1/1996

(Continued)

OTHER PUBLICATIONS

"*Final Draft International Standard*", Project No. 47C/61988-1/Ed. 1; Plasma Display Panels—Part 1: Terminology and letter symbols, published by International Electrotechnical Commission, IEC. in 2003, and Appendix A—Description of Technology, Annex B—Relationship Between Voltage Terms And Discharge Characteristics; Annex C—Gaps and Annex D—Manufacturing.

*Primary Examiner*—Karabi Guharay
(74) *Attorney, Agent, or Firm*—Robert E. Bushnell, Esq.

(57) ABSTRACT

A plasma display panel including a front substrate, a rear substrate and intermediate barrier ribs defining discharge cells and having sustain electrodes located within the intermediate barrier ribs. A space is located between the front substrate and the rear substrate and includes an emissive area and a non-emissive area about emissive area. The emissive area has a fluorescent layer within. In the non-emissive area, an epoxy compound seals the emissive area from the outside, thus improving the sealing efficiency of the plasma display panel.

18 Claims, 6 Drawing Sheets

U.S. PATENT DOCUMENTS

| | | | | |
|---|---|---|---|---|
| 2005/0093446 | A1 | 5/2005 | Hong et al. | |
| 2005/0110409 | A1* | 5/2005 | Zeng et al. | 313/582 |
| 2006/0238125 | A1* | 10/2006 | Hur et al. | 313/586 |

FOREIGN PATENT DOCUMENTS

| | | | |
|---|---|---|---|
| EP | 1071111 | A1 | 1/2001 |
| EP | 1 077 467 | | 2/2001 |
| EP | 1077467 | A1 | 2/2001 |
| JP | 02-148645 | | 6/1990 |
| JP | 2845183 | | 10/1998 |
| JP | 2917279 | | 4/1999 |
| JP | 2001-043804 | | 2/2001 |
| JP | 2001-325888 | | 11/2001 |
| JP | 2004-103562 | | 4/2004 |
| JP | 2004-247211 | | 9/2004 |
| JP | 2004-281284 | | 10/2004 |
| JP | 2004356042 | * | 12/2004 |
| JP | 2004356042 | A * | 12/2004 |

* cited by examiner

SEALED OPPOSED DISCHARGE PLASMA DISPLAY PANEL

CLAIM OF PRIORITY

This application makes reference to, incorporates the same herein, and claims all benefits accruing under 35 U.S.C. §119 from an application earlier filed in the Korean Intellectual Property Office on 13 Jun. 2005 and there duly assigned Serial No. 2005-0050245.

BACKGROUND OF THE INVENTION

1. Field of the Invention

The present invention relates to a plasma display panel. More particularly, the present invention relates to a plasma display panel that includes a front substrate, a rear substrate and Intermediate barrier ribs defining a discharge cells and having sustain electrodes located therein, in which a space between the front substrate and the rear substrate can be divided into an emissive area having a fluorescent layer and a non-emissive area around the emissive area, the non-emissive area having an epoxy molding compound sealing the space of the emissive area from the outside, thus improving the sealing efficiency of the plasma display panel.

2. Description of the Prior Art

As generally known in the art, a plasma display panel refers to a panel used in a plasma display device, which is a kind of flat display device that realizes an image from a visible ray emitted from a fluorescent layer when the fluorescent layer is excited by ultraviolet rays. The ultraviolet rays are produced by a plasma created when a gas discharge is produced in a discharge gas filling a space between two opposite substrates. Such a plasma display panel can be classified into a DC type plasma display panel, an AC type plasma display panel and an AC-DC type plasma display panel according to the structure and the driving principle thereof. In addition, the plasma display panel can be classified into a surface discharge type plasma display panel and an opposed type plasma display panel according to the discharge structure thereof. Recently, AC-type three-electrode surface discharge plasma panels have been extensively used.

A plasma display panel generally includes a front substrate, a rear substrate opposing the front substrate, and an electrode required for the discharge operation. The front substrate is a glass substrate having a thickness of about 2.8 mm and is made out of a transparent soda glass such that a visible rays produced in the fluorescent layer may pass therethrough. A pair of X-Y electrodes are provided at a lower surface of the front substrate in order to generate a sustain discharge. Such electrodes include a transparent electrode that can be made out of ITO (Indium Tin Oxide). A bus electrode is formed at a lower portion of the transparent electrode. The bus electrode has a width smaller than that of the transparent electrode and compensates for line resistance of the transparent electrode. The front substrate is provided at the lower surface thereof with a dielectric layer in order to cover the transparent electrodes therein so that the transparent electrodes are prevented from being exposed. In addition, a passivation layer is formed on the dielectric layer in order to protect the dielectric layer.

On an upper surface of the rear substrate are address electrodes that are alternately located with the transparent electrodes formed on the lower surface of the front substrate. In addition, similar to the front substrate, a dielectric layer covers the address electrodes to prevent the address electrodes formed on the upper surface of the rear substrate from being exposed. Barrier ribs are formed on the upper surface of the rear substrate so as to prevent electro-optical cross-talk between neighboring discharge cells while maintaining a discharge distance. The barrier ribs are provided between the front and the rear substrates to form spaces for generating the plasma discharge and to define discharge cells. The discharge cells are elements of pixels serving as basic units for displaying an image in a plasma display panel. Red, green and blue fluorescent layers are coated on both sidewalls of the barrier ribs that define the discharge cells as well as on portions of the upper surface of the dielectric layer of the rear substrate where the barrier ribs are not present.

The plasma display panel having the above structure adjusts the number of sustain discharge operations according to video data transmitted thereto, thus achieving a gray scale required for displaying an image. In order to represent the gray scale, an ADS (address and display period separated) scheme is used where one frame is driven while being divided into a plurality of sub-fields having different numbers of discharging operations. According to the ADS scheme, each sub-field is divided into a reset period for uniformly generating the discharge, an address period for selecting a discharge cell and sustain and erase periods for expressing the gray scale according to the number of the discharge operations.

During the address period of the sub-field, an address discharge is generated due to a difference between an address voltage applied to an address electrode located at a lower portion of a selected discharge cell causing the discharge to be produced and causing a ground voltage to be applied to a scan electrode (Y electrode). In addition, although an address voltage with straight polarity is applied to the address electrodes located at the lower portion of the selected discharge cell, a ground voltage is applied to other, non-selected address electrodes. Therefore, if a display data signal of the address voltage having the straight polarity is applied while a scan pulse of the ground voltage is being applied, a wall charge is formed in the corresponding discharge cells due to the address discharge, but the wall charge is not formed in the other, non-selected discharge cells. The sustain electrode (X electrode) is maintained with a predetermined voltage for effectively generating the address discharge during the address period. Intensity of the address voltage required for the address discharge may exert influence upon optical efficiency, structure and materials in the display panel. Specifically, as the intensity of the address voltage rises, power consumption may increase, so that the optical efficiency is reduced. This is caused by a sputtering effect that is increasingly generated in the dielectric layers of the rear and front substrates, causing the number of charged particles moving into adjacent discharge cells through the barrier ribs to increase (that is, the cross-talk may increase). Therefore, typically, it is advantageous to keep the address firing voltage low.

However, according to the three-electrode type surface discharge scheme, since a distance between the scan electrode and the address electrode is small, a relatively large discharge voltage is required. In addition, the discharge starts at an area in which a distance between two electrodes is smallest (i.e., at a center area of a discharge cell). After initiation, the discharge is produced at a peripheral area of the electrodes. That is, when a low firing voltage is applied to the center of the discharge cell, the discharge is produced in the center of the discharge cell. Once the discharge is initiated, space charges are generated so that the discharge operation can be maintained at a voltage that is lower than the firing voltage, allowing for the voltage applied between two electrodes to be gradually reduced as time goes by. As the discharge operation starts, ions and electrons are accumulated in the center of the discharge cell so that the intensity of an electric field in the center of the discharge cell can be reduced so that the discharge in the center of the discharge cell can vanish. That is, since the voltage applied between two electrodes reduces with time, a strong discharge may occur at the center of the discharge cell having a low light efficiency and a weak discharge may occur at the peripheral portion of the discharge cell having a high light efficiency. In such a scenario, the plasma display panel employing the three-electrode type surface discharge scheme uses a relatively lower amount of input energy for heating electrons, so that the light efficiency of the plasma display panel can be degraded.

Recently, in order to solve the problem occurring in the plasma display panel employing the above three-electrode type surface discharge scheme, a plasma display panel employing an opposed discharge scheme has been developed. According to the opposed discharge scheme, an X electrode and a Y electrode are formed in intermediate barrier ribs and oppose each other at a space formed between a front substrate and a rear substrate. Address electrodes are located alternately with the X and Y electrodes in the vertical direction. Therefore, according to the plasma display panel employing the opposed discharge scheme, a distance between a scan electrode and an address electrode is smaller than a distance between the scan electrode and the address electrode of the plasma display panel employing the surface discharge scheme, so that the address voltage is relatively lower. In addition, according to the opposed discharge scheme, the plasma discharge is generated over the whole area of the discharge cell so that a discharge space is enlarged, thus increasing the discharge efficiency. In the meantime, according to the opposed discharge scheme, the discharge space formed between the front substrate and the rear substrate must be sealed. If the sealing efficiency is degraded, discharge gas can leak or the light emitting efficiency can be lowered, thus degrading the brightness of the panel.

However, in the plasma display panel employing the opposed discharge scheme, it is difficult to effectively seal the discharge space formed between the front substrate and the rear substrate as compared with the plasma display panel employing the surface discharge scheme. In particular, if the plasma display panel is fabricated with intermediate barrier ribs separately formed between the front substrate and the rear substrate to define the discharge cells, it is necessary to simultaneously seal gaps formed between the front substrate and the intermediate barrier ribs as well as between the rear substrate and the intermediate barrier ribs, respectively, so that the sealing efficiency may be degraded. Therefore, what is needed is an improved design for an opposed discharge scheme plasma display panel.

SUMMARY OF THE INVENTION

It is therefore an object of the present invention to provide an improved design for an opposed discharge plasma display panel.

Accordingly, the present invention has been made to solve one or more of the above-mentioned problems occurring in the prior art, and an object of the claimed invention is to provide a plasma display panel including a front substrate, a rear substrate and intermediate barrier ribs defining discharge cells and having sustain electrodes located within the intermediate barrier ribs. A space is located between the front substrate and the rear substrate and includes an emissive area and a non-emissive area about emissive area. The emissive area has a fluorescent layer within. In the non-emissive area, an epoxy compound seals the emissive area from the outside, thus improving the sealing efficiency of the plasma display panel.

In order to accomplish the above object, the present invention provides a plasma display panel includes a first substrate and a second substrate arranged in opposition to each other, each of the first and the second substrates spanning an emissive area and a non-emissive area surrounding the emissive area and at a periphery of the emissive area, a plurality of intermediate barrier ribs between the first and the second substrates, having a grating structure and defining a plurality of discharge cells, the plurality of intermediate barrier ribs including a plurality of first barrier ribs extending in a first direction parallel to each other between the first and the second substrates and a plurality of second barrier ribs extending perpendicular to the plurality of first barrier ribs, a plurality of sustain electrodes including first and second electrodes arranged within the plurality of first barrier ribs and extending parallel to the plurality of first barrier ribs and alternately located about ones of the plurality of discharge cells, the first and the second electrodes being shared by adjacent ones of said plurality of discharge cells, a plurality of address electrodes arranged on an upper surface of the first substrate and extending parallel to the plurality of second barrier ribs, a fluorescent layer arranged within the emissive area and on at least one of the first and the second substrates and an epoxy molding compound arranged within the non-emissive area and adapted to seal a space occupied by the emissive area between the first and the second substrates.

The plurality of intermediate barrier ribs can be arranged within both the emissive area and the non-emissive area, and an interval between adjacent and parallel ones of the plurality of intermediate barrier ribs within the non-emissive area can be greater than an interval between adjacent and parallel ones of the plurality of intermediate barrier ribs arranged within the emissive area. An interval between adjoining and parallel ones of the plurality of intermediate barrier ribs arranged within the non-emissive area and extending parallel to the epoxy molding compound can be greater than an interval between adjoining and parallel ones of the plurality of intermediate barrier ribs arranged within the non-emissive area and extending orthogonal to the epoxy molding compound. The interval between adjoining and parallel ones of the plurality of intermediate barrier ribs arranged within the non-emissive area and extending parallel to the epoxy molding compound can be greater than a width of the epoxy molding compound. The interval between adjoining and parallel ones of the plurality of intermediate barrier ribs arranged at both lateral sides of the epoxy molding compound and extending parallel to the epoxy molding compound can be greater than a width of the epoxy molding compound.

According to the present invention, the plurality of discharge cells can include a plurality of emissive discharge cells arranged within the emissive area, and a plurality of non-emissive discharge cells arranged within the non-emissive area, wherein a length of an edge of each of the plurality of non-emissive discharge cells extending in a direction perpendicular to the epoxy molding compound can be greater than edges of said plurality of emissive discharge cells. A length of an edge of each of the plurality of non-emissive discharge cells extending perpendicular to the epoxy molding compound can be greater than a width of the epoxy molding compound. A length of an edge of each of the plurality of non-emissive discharge cells extending perpendicular to the epoxy molding compound can be at least 5 mm.

Furthermore, the epoxy molding compound can include glass frit. The epoxy molding compound can have a height equal to or higher than a height of each of the plurality of intermediate barrier ribs.

BRIEF DESCRIPTION OF THE DRAWINGS

A more complete appreciation of the invention and many of the attendant advantages thereof, will be readily apparent as the same becomes better understood by reference to the following detailed description when considered n conjunction with the accompanying drawings in which like reference symbols indicate the same or similar components, wherein.

DETAILED DESCRIPTION OF THE INVENTION

Figure 1A:
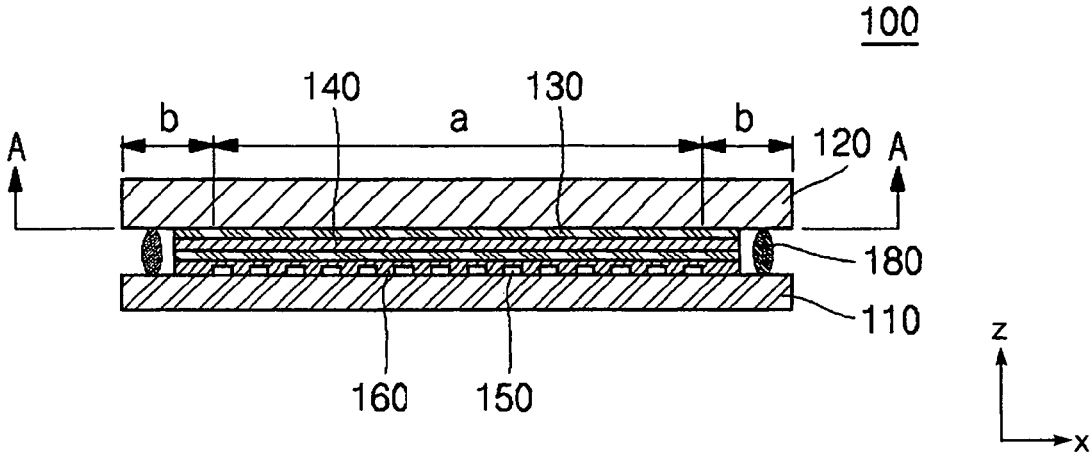
FIG. 1A is a longitudinal section view illustrating a plasma display panel according to a first embodiment of the present invention.
Figure 1B:
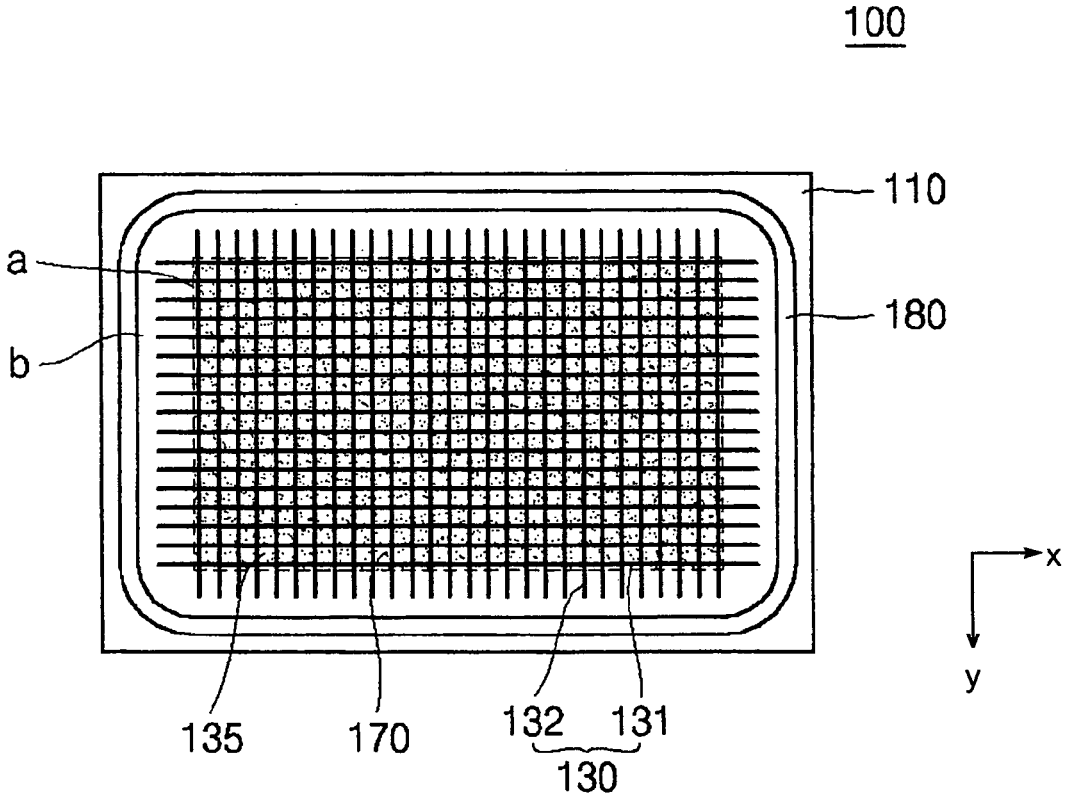
FIG. 1B is a horizontal sectional view taken along line A-A shown in FIG. 1A.
Figure 1C:
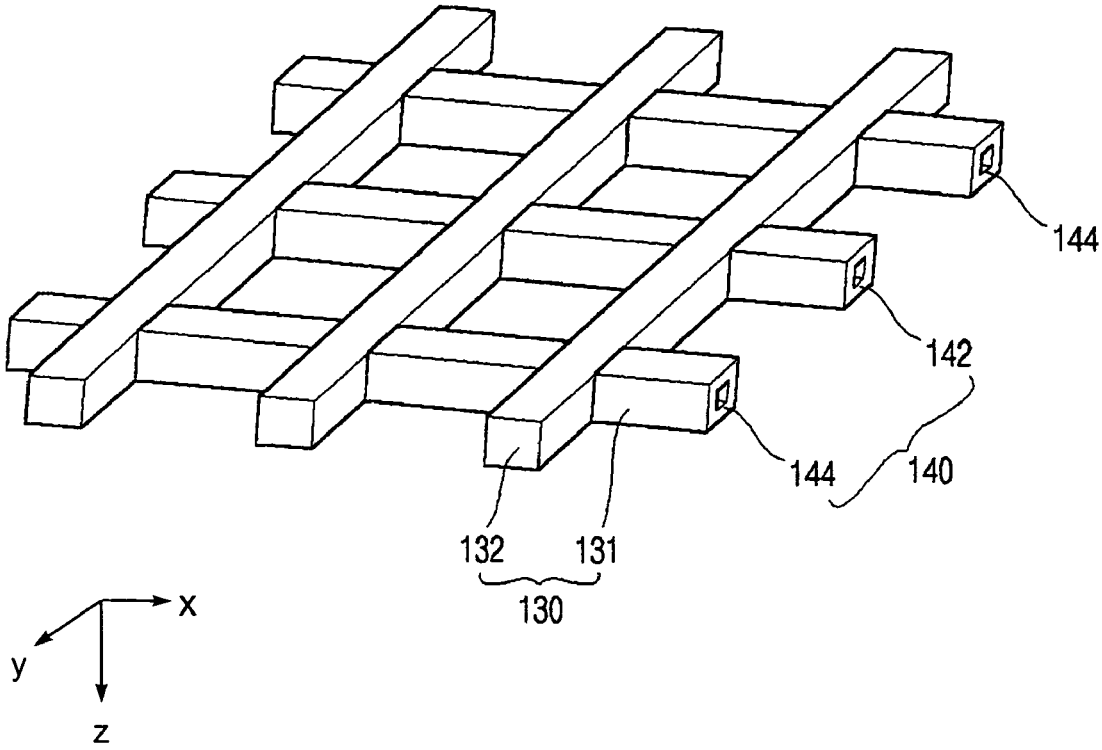
FIG. 1C is a partial perspective view illustrating intermediate barrier ribs according to the first embodiment of the present invention.

Turning now to FIGS. 1A through 1C, FIG. 1A is a longitudinal section view illustrating a plasma display panel according to a first embodiment of the present invention, FIG. 1B is a horizontal sectional view taken along line A-A of FIG. 1A, and FIG. 1C is a partially perspective view illustrating the intermediate barrier ribs according to the present invention.

Referring to FIGS. 1A through 1C, the plasma display panel according to the first embodiment of the present invention includes a first substrate (hereinafter, referred to as a rear substrate) 110, a second substrate (hereinafter, referred to as a front substrate) 120, barrier ribs 130, sustain electrodes 140, a fluorescent layer 170 and an epoxy molding compound 180. In addition, the plasma display panel also includes address electrodes 150 and a dielectric layer 160.

The rear substrate 110 and the front substrate 120 are opposed to each other while forming a space therebetween. This space between the two substrates is partitioned by the plurality of harrier ribs into a plurality of discharge cells 135.

The rear substrate 110 is made out of glass and forms the plasma display panel together with the front substrate 120. The front substrate 120 is made out of a transparent material, such as soda glass, and is located to oppose the rear substrate 110. In the following description, surfaces of elements on a side of the rear substrate 110 facing the front substrate 120 (i.e., the +Z-axis direction in FIG. 1A) are referred to as "the upper surface" of rear substrate. Surface elements on a side of front substrate 120 facing rear substrate 110 (i.e., the −Z-axis direction in FIG. 1A) are referred to as "the lower surface" of front substrate 120.

The space located between the rear and front substrates 110 and 120 is divided into an emissive area (a) and a non-emissive area (b) on a horizontal (x-y) plane. That is, a plane of the plasma display panel is divided into the emissive area (a) formed over the main area of the panel that displays images and the non-emissive area (b) formed at an outer peripheral portion of the emissive area (a) where no images are displayed. In addition, the fluorescent layer 170 is formed on at least one of the rear substrate 110 and the front substrate 120 and within the emissive area (a). The discharge cells 135 are formed in the emissive area (a). Sustain and address discharges are generated due to the discharge voltage applied to the sustain electrodes 140 and address electrodes 150 shared by the discharge cells 135. The fluorescent layer 170 is not formed on a predetermined area of the rear substrate 110 or the front substrate 120 corresponding to the non-emissive area (b). In addition, in the first embodiment, the discharge cells 135 are not formed in the predetermined area corresponding to the non-emissive area (b) by the intermediate barrier ribs 130. Even if the discharge cells 135 were to be formed in the non-emissive area (b), sustain electrodes 140 are not formed in the intermediate barrier ribs 130 or the discharge voltage is not applied to the sustain electrodes 140 or address electrodes 150 shared by the discharge cells 135 so that the plasma discharge can not occur in non-emissive area (b).

The intermediate barrier ribs 130 include first barrier ribs 131 located parallel to each other in one direction (that is, the x-axis direction in FIG. 1B) and second barrier ribs 132 located perpendicularly to the first barrier ribs 131 (that is, the y-axis direction in FIG. 1B). In addition, the intermediate barrier ribs 130 are positioned between the rear substrate 110 and the front substrate 120 and define the plurality of discharge cells 135 forming discharge spaces. In the first embodiment, the intermediate barrier ribs 130 are located such that the discharge cells 135 are formed in an area including the emissive area (a). Preferably, the intermediate barrier ribs 130 are located such that the discharge cells 135 are formed in an area corresponding to the emissive area (a). In the meantime, the sustain electrodes 140 are located within first barrier ribs 131.

The intermediate barrier ribs 130 are made out of glass substances including components, such as Pb, B, Si, Al or O. Preferably, the intermediate barrier ribs 130 are formed by using dielectric substances including a filler such as $ZrO_2$, $TiO_2$, or $Al_2O_3$, and a pigment such as Cr, Cu, Co or Fe. However, the present invention is not limited to these materials for the intermediate barrier ribs 130 and the intermediate barrier ribs 130 can be formed using other various dielectric substances. The intermediate barrier ribs 130 facilitate the discharge operation of the electrodes arranged within while preventing the electrodes from being damaged due to collision with charged particles, which are accelerated during the discharge operation.

MgO passivation layers (not shown) are formed at sidewalls of the intermediate barrier ribs 130 corresponding to the sustain electrodes 140. The MgO passivation layer is made out of a material including MgO and serves to protect the dielectric substance in the plasma display panel. The MgO passivation layer prevents the electrodes from being damaged during the discharge operation and emits secondary electrons that the discharge voltage.

Since the discharge cells 135 are formed in the emissive area (a) of the rear substrate 110 or the front substrate 120, the discharge cells 135 emit visible rays from the fluorescent layer 170 formed in the emissive area (a) during the discharge operation, thus displaying images. In addition, as shown in FIG. 1B, the discharge cells 135 are located along the x and y-axis directions and have predetermined dimensions. The discharge cells 135 are filled with a discharge gas (e.g., mixture gas including Xe, Ne, etc) in order to generate the plasma discharge in the discharge cells 135. In addition, the width and length of the discharge cells 135 may vary depending on the light emitting efficiency of the fluorescent layers 170. In the first embodiment, the discharge cells 135 are not formed in the non-emissive area (b) at the outer peripheral portion of the emissive area (a), so that an image can not be produced in the non-emissive area (b).

The sustain electrodes 140 include first and second electrodes 142 and 144 which are oriented in parallel to each other and to the first barrier ribs 131 of the intermediate barrier ribs 130. In addition, the first and second electrodes 142 and 144 are arranged in an alternate manner about the discharge cells 135. Adjacent discharge cells 135 may share the same first or second electrodes 142 or 144. Thus, pairs of the first and second electrodes 142 and 144 may perform the plasma discharge operation while being symmetrically arranged about the discharge cells 135.

Since the first and second electrodes 142 and 144 are located within the first barrier ribs 131, it is not necessary for the first and second electrodes 142 and 144 to be transparent. Thus, the first and second electrodes 142 and 144 can be made out of highly conductive, opaque metals such as Ag, Al or Cu. When such materials are used for the first and the second electrodes 142 and 144, they can have a fast response speed during the discharge operation while preventing signal distortion and reducing power consumption required for the sustain discharge. However, the present invention does not limit the first and the second electrodes 142 and 144 to these materials, as other materials, especially those having superior conductivity and low resistance characteristics, can also be used.

The address electrodes 150 are formed on the rear substrate 110 parallel to the second barrier ribs 132 (i.e., the y direction). Preferably, the address electrodes 150 are positioned at lower center portions (i.e., the −z side) of the discharge cells 135. The address electrodes 150 generate the address discharge together with the one of the first electrode 142 and the second electrode 144 that serves as the scan electrode. The address electrodes 150 are formed in the second barrier ribs 132 of the intermediate barrier ribs 130 without being formed on the rear substrate 110. In addition, the address electrodes 150 can further include auxiliary electrodes (not shown) protruding toward the discharge cells 135.

The fluorescent layer 170 is formed on at least one of the rear substrate 110 and the front substrate 120 and within the discharge cells 135. In particular, the fluorescent layer 170 is formed within the emissive area (a) on either the rear substrate 110 or the front substrate 120. Thus, the plasma display panel displays the image only in the emissive area (a) that has the fluorescent layer 170. The fluorescent layer 170 generates visible rays by absorbing vacuum ultraviolet rays generated during the plasma discharge operation. As described above, the discharge cells 135 and the fluorescent layer 170 are not formed in the non-emissive area (b) located at the outer peripheral portion of the emissive area (a) of the rear substrate 110 or the front substrate 120 in the first embodiment. Accordingly, an image is not displayed in the non-emissive area (b).

The fluorescent layer 170 is made up of material capable of generating visible rays when excited by ultraviolet rays. A red fluorescent layer located within a red emitting discharge cell includes fluorescent substances such as $Y(V,P)O_4$:Eu. A green fluorescent layer located within a green emitting discharge cell includes fluorescent substances such as $Zn_2SiO_4$:Mn. A blue fluorescent layer located within a blue emitting discharge cell includes fluorescent substances such as BAM:Eu. That is, the fluorescent layer 170 is divided into the red, green and blue emitting fluorescent layers provided in the discharge cells 135. In addition, adjacent discharge cells 135 having the red, green and blue emitting fluorescent layers are combined with each other to form unit pixels for displaying color images.

The epoxy molding compound 180 is located in the non-emissive area (b) formed at the outer peripheral portion of the emissive area (a) and has a closed curve structure having the predetermined width and height to seal the space between the rear and the front substrates 110 and 120. Accordingly, the intermediate barrier ribs 130 defining the emissive area (a) and the discharge cells 135 formed in the emissive area (a) are surrounded by the epoxy molding compound 180. In the first embodiment, all discharge cells 135 are located in the emissive area (a) and are surrounded and sealed by the epoxy molding compound 180. In addition, all intermediate barrier ribs 130 defining the discharge cells 135 are also surrounded by the epoxy molding compound 180.

The epoxy molding compound 180 is made out of glass frit. However, the present invention is in no way so limited as the epoxy molding compound can be made of other materials such as various glasses having low melting points. For instance, the glass frit includes glass powder, which mainly consists of PbO—$B_2O_3$ and ZnO, $Al_2O_3$, $SiO_2$ or $V_2O_5$ added to PbO—$B_2O_3$ in or improve wetting and waterproof properties. In addition, the glass frit can be in the form of paste mixed with nitro-cellulous based self-inflammable bonding agents. Although the glass frit has rigidity when it is cured, the glass frit has a superior airtight property as glass frit is often also used as a sealant for sealing pipe members.

The epoxy molding compound 180 is coated on the rear or the front substrate 110 or 120 to a predetermined width and thickness and is melted when the sealing process is performed. Accordingly, the epoxy molding compound 180 is coated between planar rear and front substrates 110 and 120 and seals the space between the rear and front substrates 110 and 120 that includes the emissive area (a) via the sealing process so that the emissive area (a) can be sealed from the exterior.

Since the intermediate barrier ribs 130 are shielded from the exterior by the epoxy molding compound 180, the sustain electrodes 140 formed in the intermediate barrier ribs 130 must be electrically connected to an external printed circuit board (not shown) through a separate conductive member (not shown). For instance, the separate conductive member can be a signal transfer device, such as a tape carriage package (TCP) or a chip on film (COF). One end of the conductive member is connected to each sustain electrode 140 formed in the intermediate barrier ribs 130 and the other end of the conductive member is electrically connected to the external printed circuit board. In such an arrangement, the conductive member can extend by passing through the epoxy molding compound 180. Preferably, the conductive member extends perpendicular to the installation direction of the epoxy molding compound 180 by passing through a gap formed between the epoxy molding compound 180 and the rear substrate 110 or between epoxy molding compound 180 and the front substrate 120.

Figure 2A:
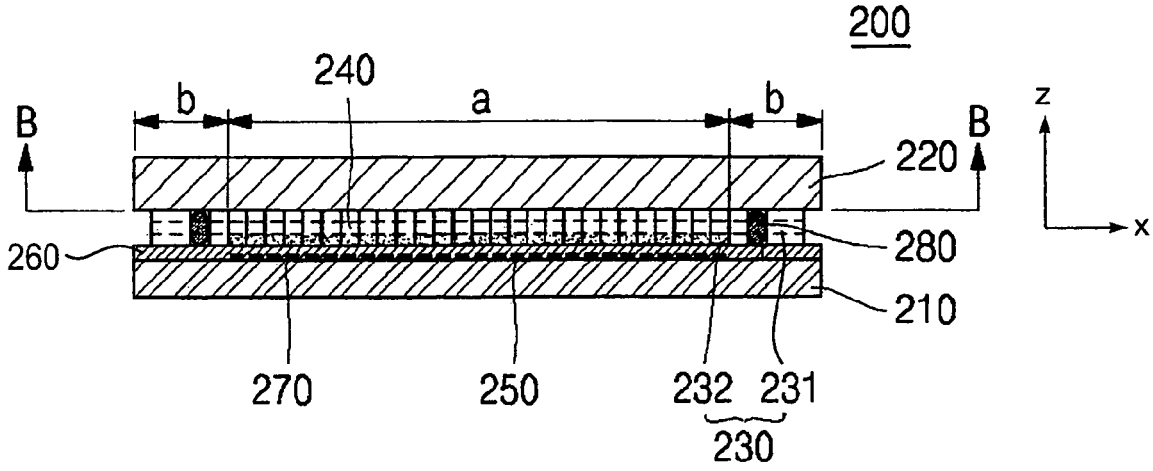
FIG. 2A is a longitudinal section view illustrating a plasma display panel according to a second embodiment of the present invention.
Figure 2B:
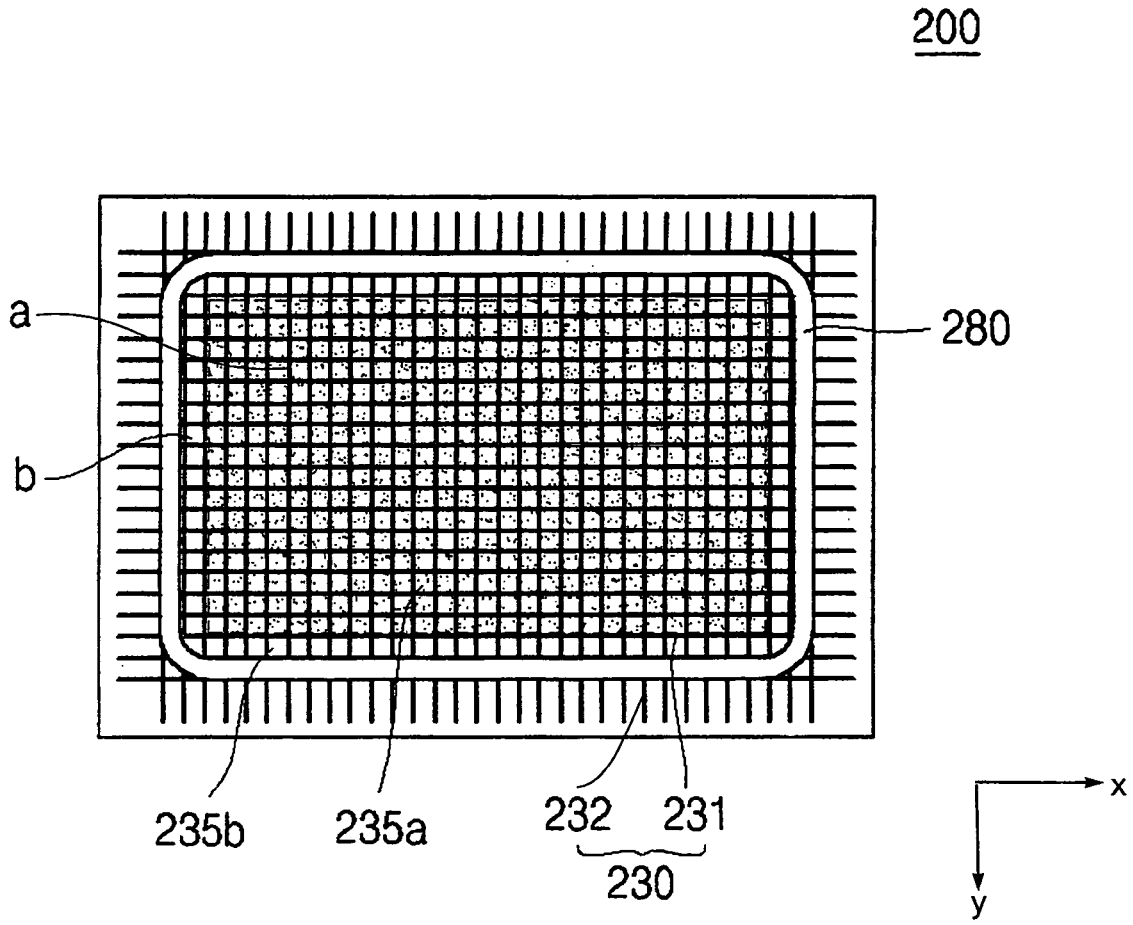
FIG. 2B is a horizontal sectional view taken along line B-B shown in FIG. 2A.

Turning now to FIGS. 2A and 2B, the plasma display panel according to the second embodiment of the present invention will now be described. FIG. 2A is a longitudinal section view illustrating the plasma display panel according to the second embodiment of the present invention and FIG. 2B is a horizontal sectional view taken along line B-B of FIG. 2A. The plasma display panel according to the second embodiment of the present invention is substantially similar to the plasma display panel according to the first embodiment of the present invention of FIGS. 1A through 1C, so the following description will focus on their differences.

Referring to FIGS. 2A and 2B, the plasma display panel according to the second embodiment of the present invention includes a rear substrate 210, a front substrate 220, barrier ribs 230, sustain electrodes 240, a fluorescent layer 270 and an epoxy molding compound 280. In addition, the plasma display panel also includes address electrodes 250 and a dielectric layer 260.

The space between the rear and the front substrates 210 and 220 is divided into an emissive area (a) and a non-emissive area (b) about the horizontal xy plane. That is, the xy plane of the plasma display panel is divided into the emissive area (a) located in the main area of the panel that displays images and the non-emissive area (b) around an outer periphery of the emissive area (a), the non-emissive area (b) not displaying images The intermediate barrier ribs 230 include first barrier ribs 231 located parallel to each other in one direction (i.e., the x-axis direction in FIG. 2B) and second barrier ribs 232 located perpendicular to the first barrier ribs 231 (i.e., the y-axis direction in FIG. 2B). In addition, the intermediate barrier ribs 230 are located between the rear substrate 210 and the front substrate 220 and define a plurality of discharge cells 235 forming the discharge spaces. In the arrangement of FIGS. 2A and 2B, the intermediate barrier ribs 230 are located so that the discharge cells 235 are located in both the emissive area (a) and the non-emissive area (b).

The discharge cells 235 defined by the intermediate barrier ribs 230 include emissive discharge cells 235*a* formed in the emissive area (a) and non-emissive discharge cells 235*b* formed in the non-emissive area (b). In addition, as shown in FIG. 2B, the discharge cells 235 are located along the x and y-axis directions and have a predetermined dimensions. That is, all the discharge cells 235 in the second embodiment have the same size regardless of their location on the display. The emissive discharge cells 235*a* are formed in the emissive area (a) over the main area of the plasma display panel. The non-emissive discharge cells 235*b* include outermost discharge cells located in the outermost locations in the x and y-axis directions and several discharge cells located between the outermost discharge cells and the emissive area (a). That is, the non-emissive discharge cells 235*b* consist of a predetermined number of discharge cells so that the combined width of the non-emissive discharge cells 235*b* is larger than the width of the epoxy molding compound 280. For instance, if the epoxy molding compound 280 has the width corresponding to the width of one discharge cell, the non-emissive discharge cells 235*b* include an outermost discharge cells and inner discharge cells forming a column and a row of the discharge cells inside the outermost discharge cells. However, since the width of an individual discharge cell 235 is generally smaller than that of the epoxy molding compound 280, the non-emissive discharge cells 235*b* include a plurality of discharge cells formed vertically to the epoxy molding compound 280. Although it is illustrated in FIG. 2B that the epoxy molding compound 280 has a width identical to that of one discharge cell 235, this is illustrative and it is to be understood that more numerous discharge cells 235*b* exist in the non-emissive area (b) than is illustrated in FIG. 2B. In actuality, the epoxy molding compound 280 is formed over several discharge cells 235*b* and not just one as is illustrated in FIG. 2B.

The fluorescent layer 270 is formed on at least one of the rear substrate 210 and the front substrate 210 and within the emissive area (a). That is, the fluorescent layer 270 is formed in the emissive discharge cells 235*a* located within the emissive area (a). However, the fluorescent layer 270 is not formed in the non-emissive discharge cells 235*b* located within the non-emissive area (b). Therefore, when the plasma display panel generates the plasma discharge, the fluorescent layer 270 formed in the emissive discharge cells 235*a* can emit visible rays, thus displaying the image. Conversely, the non-emissive discharge cells 235*b* can not emit the visible rays because they are absent the fluorescent layer 270. The emissive discharge cells 235*a* generate the address discharge and the sustain discharge when the discharge voltage is applied to the address electrodes 250 and the sustain electrodes 240 located within the emissive discharge cells 235*a*. Since the fluorescent layer 270 is not formed in the non-emissive discharge cells 235*b*, and since there are no address electrodes 250 in the non-emissive discharge cells 235*b*, no plasma discharge occurs in the non-emissive area (b).

The epoxy molding compound 280 is formed within the non-emissive area (b) and outside the emissive area (a). The epoxy molding compound 280 has a closed curve structure and is formed to a predetermined width and height to seal the space between the rear and the front substrates 210 and 220 from the outside. In addition, the epoxy molding compound 280 has the height equal to or higher than that of the intermediate barrier ribs 230 and makes contact with the rear and the front substrates 210 and 220 while occupying non-emissive discharge cells 235*b*. Thus, the epoxy molding compound 280 makes contact with the rear substrate 210, the front substrate 220 and inner walls of the intermediate barrier ribs 230 within the non-emissive discharge cells 235*b*, thus sealing the emissive area (a) from the outside.

In addition, since the epoxy molding compound 280 is formed in the non-emissive area (b) occupying the non-emissive discharge cells 235*b* adjacent to each other in the x and y-axis directions of FIG. 2B, the width of the epoxy molding compound 280 is smaller than the combined width of the non-emissive discharge cells 235*b*. The epoxy molding compound 280 is vertically formed over several non-emissive discharge cells 235*b*. FIG. 2B shows the epoxy molding compound 280 having the width identical to that of one non-emissive discharge cell 235*b* for illustrative purposes. If the width of the epoxy molding compound 280 is larger than the combined width of the non-emissive discharge cells 235*b*, the epoxy molding may then cover a part of the emissive discharge cells 235*a* so that the size of the emissive discharge cells 235*a* becomes reduced.

When the intermediate barrier ribs 230 are formed on the rear substrate 210, the epoxy molding compound 280, in the form of paste or powder of glass frit, is coated on the rear substrate 210 along the non-emissive discharge cells 235*b* formed in the non-emissive area (b), and is melted when the sealing process is performed. Preferably, the epoxy molding compound 280 is coated along the non-emissive discharge cells 235*b* including the outermost non-emissive discharge cells 235*b*, thus preventing the light emitting efficiency of the emissive area (a) from being degraded after the epoxy molding compound 280 has been coated. In addition, since the epoxy molding compound 280 is coated while filling the non-emissive discharge cells 235*b*, it is not necessary to provide an auxiliary tool, such as a frame used for maintaining the shape of glass frit in the form of paste or powder.

In addition, since the epoxy molding compound 280 is coated along the non-emissive discharge cells 235*b* formed at the outer peripheral portion of the intermediate barrier ribs 230, the outermost portion of the intermediate barrier ribs 230 in the second embodiment is located outside the epoxy molding compound 280. This is different from the first embodiment of the present invention where an entirely of the intermediate barrier ribs 130 were located within the epoxy molding compound 180. In the second embodiment, each lateral end portion of the intermediate barrier ribs 230 are located outside the epoxy molding compound 280 so that side ends of the sustain electrodes 240 can extend outside the epoxy molding compound 280. Accordingly, it is not necessary for the conductive member, which is used to electrically connect the sustain electrodes 240 to the external printed circuit board (not shown), to pass through the epoxy molding compound 280 as in the first embodiment. As a result, installation work for the conductive member in the second embodiment can be more easily performed than in the first embodiment.

Figure 3A:
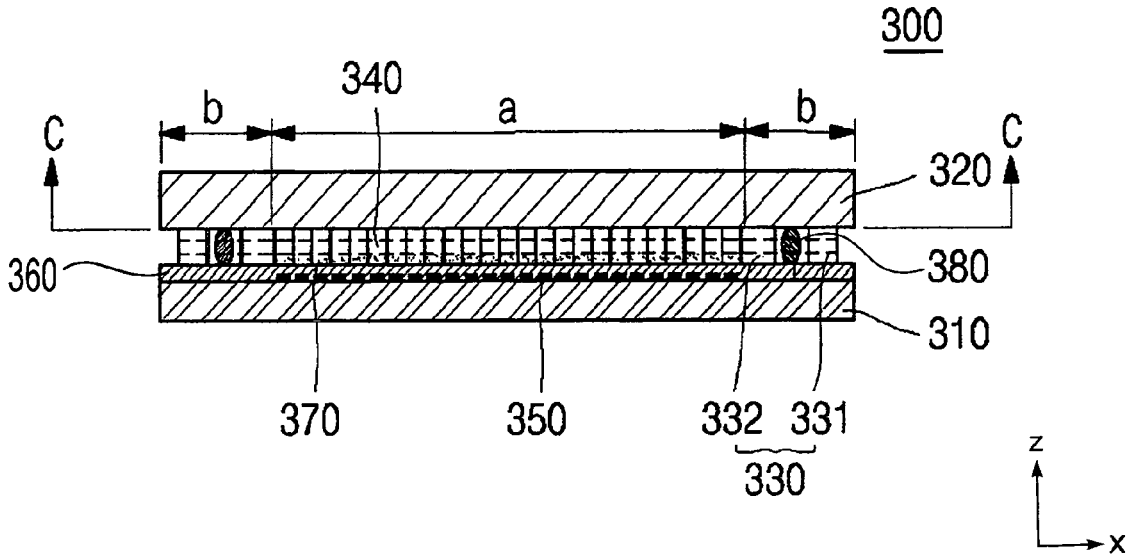
FIG. 3A is a longitudinal section view illustrating a plasma display panel according to a third embodiment of the present invention.
Figure 3B:
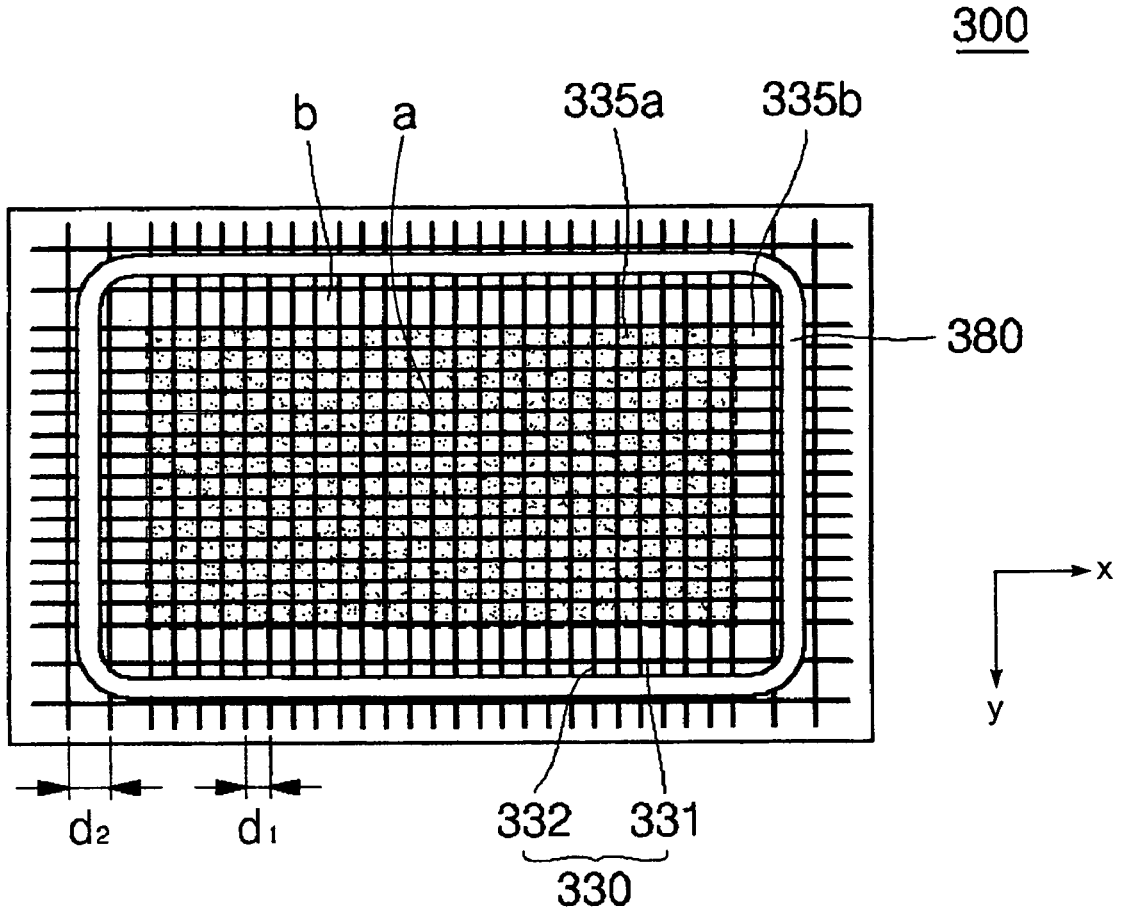
FIG. 3B is a horizontal sectional view taken along line C-C shown in FIG. 3A.

Turning now to FIGS. 3A and 3B, the plasma display panel according to the third embodiment of the present invention will be described. FIG. 3A is a longitudinal section view illustrating the plasma display panel according to the third embodiment of the present invention and FIG. 3B is a horizontal sectional view taken along line C-C of FIG. 3A. The plasma display panel according to the third embodiment of the present invention is substantially similar to the plasma display panel according to the second embodiment of FIGS. 2A and 2B, so the following description will be focused on differences.

Referring to FIGS. 3A and 3B, the plasma display panel according to the third embodiment of the present invention includes a rear substrate 310, a front substrate 320, barrier ribs 330, sustain electrodes 340, a fluorescent layer 370 and an epoxy molding compound 380. In addition, the plasma display panel also includes address electrodes 350 and a dielectric layer 360.

The space between the rear and front substrates 310 and 320 is divided into an emissive area (a) and a non-emissive area (b) about a horizontal xy plane. That is, the xy plane of the plasma display panel is divided into the emissive area (a) formed over the main area of the panel to display an image and the non-emissive area (b) formed around the emissive area (a). An image is produced in the emissive area (a) but not in the non-emissive area (b).

The intermediate barrier ribs 330 include first barrier ribs 331 located parallel to each other in one direction (i.e., the x-axis direction in FIG. 3B) and second barrier ribs 332 located perpendicularly to the first barrier ribs 331 (i.e., the y-axis direction in FIG. 3B). In addition, the intermediate barrier ribs 330 are positioned between the rear substrate 310 and the front substrate 320 and divide the space between these substrates into a plurality of discharge cells 335.

The intermediate barrier ribs 330 are located so that the discharge cells 335 are formed both in the emissive area (a) and in the non-emissive area (b). The discharge cells 335 defined by the intermediate barrier ribs 330 include emissive discharge cells 335*a* formed in the emissive area (a) and non-emissive discharge cells 335*b* formed in the non-emissive area (b). Unlike the first two embodiments, the size of the discharge cells 335 located within the emissive area (a) is different than the size of the discharge cells 335 located within the non-emissive area (b). Specifically, as shown in FIG. 3B, the width (d2) taken along the x-axis direction of the non-emissive discharge cells 335*b* provided at both lateral ends (+/−x ends) of the emissive discharge cells 335*a* is larger than the width (d1) of the emissive discharge cells 335*a*. Accordingly, an interval between the second barrier ribs 332 forming the non-emissive discharge cells 335*b* is larger than an interval between the second barrier ribs 332 forming the emissive discharge cells 335*a*. In addition, the length in the y-axis direction of FIG. 3B of the non-emissive discharge cells 335*b* provided at upper and lower ends (+/−y ends) of the emissive discharge cells 335*a* is larger than the length of the emissive discharge cells 335*a*. Thus, an interval between the first barrier ribs 331 forming the non-emissive discharge cells 335*b* is larger than an interval between the first barrier ribs 332 forming the emissive discharge cells 335*a* at the +/−y ends of the display.

As a result, the interval between the intermediate barrier ribs 330 formed in the non-emissive area (b) is larger than the interval between intermediate barrier ribs 330 located within the emissive area (a). Specifically, the interval between the intermediate barrier ribs 330 located in the non-emissive area (b) parallel to the epoxy molding compound 380 is larger than that of the intermediate barrier ribs 330 located in the non-emissive area (b) that are orthogonal to the epoxy molding compound 380.

Preferably, the interval between the intermediate barrier ribs 330 located in the non-emissive area (b) parallel to the epoxy molding compound 380 is larger than the width of the epoxy molding compound 380. In particular, the interval between the intermediate barrier ribs 330 located at both sides of the epoxy molding compound 380 parallel to the epoxy molding compound 380 can be larger than the width of the epoxy molding compound 380.

In the embodiment of FIGS. 3A and 3B, the sustain electrodes 340 including first and second electrodes 342 and 344 are located within the first barrier ribs 331. Also, the sustain electrodes 340 extend to both side ends of the first barrier ribs 331 through the epoxy molding 380.

The fluorescent layer 370 is formed on at least one of the rear substrate 310 and the front substrate 310 and within and corresponding to the emissive area (a). That is, the fluorescent layer 370 is formed in the emissive discharge cells 335*a* located in the area corresponding to the emissive area (a). However, the fluorescent layer 370 is not formed in the non-emissive discharge cells 335*b* located in the area corresponding to the non-emissive area (b).

The epoxy molding compound 380 is formed along the non-emissive area (b) located at the outer peripheral portion of the emissive area (a) and has a closed curve structure having the predetermined width and height to seal the space between the rear and the front substrates 310 and 320 located and within the emissive area (a). In addition, the epoxy molding compound 380 has the height equal to or higher than that of the intermediate barrier ribs 330 and makes contact with the rear and the front substrates 310 and 320 while vertically passing through the non-emissive discharge cells 335*b*.

In addition, in a state in which the intermediate barrier ribs 330 are formed on the rear substrate 310, the epoxy molding compound 380 in the form of paste or powder of glass frit is coated on the rear substrate 310 along the non-emissive discharge cells 335*b* formed in the non-emissive area (b). The epoxy molding compound 380 is then melted when the sealing process is performed. While the sealing process is being performed, the glass frit expands or shrinks, so that it is desirable to provide a design about the glass frit to allow for this movement.

However, the intermediate barrier ribs 330 provided in the coating area of the glass frit can hinder the movement of the glass frit. For this reason, preferably, the width of the epoxy molding compound 380 is designed to be smaller than the width (d2) of the non-emissive discharge cells 335*b* formed at left and right portions (+/−x portions) of the emissive discharge cells 335*a*. The width of the epoxy molding compound is designed to be smaller than the length of the non-emissive discharge cells 335*b* formed at upper and lower portions (+/−y portions) of the emissive discharge cells 335*a*. In other words, the width of the epoxy molding compound 380 is smaller than the edges of the non-emissive discharge cells 335*b* formed vertically to the epoxy molding compound 380. Accordingly, when the epoxy molding compound 380 is formed, the glass frit is coated along the non-emissive discharge cells 335*b* having the relatively large width and length in the x and y-axis directions, so that the glass frit can easily expand and shrink within the non-emissive discharge cells 335*b* during the melting and curing processes and can easily move. In addition, since the non-emissive discharge cells 335*b* have the relatively large width and length, a relatively large amount of glass frit is coated along the non-emissive discharge cells 335*b* so that the glass frit can easily flow during the sealing process. Thus, the epoxy molding compound 380 can be evenly coated over the whole area of the rear substrate 310 or the front substrate 320 to a uniform thickness. In addition, since the glass frit can easily flow during the melting process, the epoxy molding compound 380 can form smooth contact surfaces in the sealing parts between the rear substrate 310 and the epoxy molding compound 380 or between the front substrate 320 and the epoxy molding compound 380, thus improving the sealing efficiency.

In the meantime, since the width of the epoxy molding compound 380 is less than 5 mm, the non-emissive discharge cells 335*b* located vertically to the epoxy molding compound 380 preferably has the width of at least 5 mm. As mentioned above, the width of the non-emissive discharge cells 335*b* must be larger than the width of the epoxy molding compound 380 in order to facilitate the movement of the glass frit during the melting process.

As described above, the plasma display panel according to the present invention includes the front substrate, the rear substrate and the intermediate barrier ribs defining the discharge cells and having the sustain electrodes located therein. An epoxy molding compound is coated in the non-emissive area to seal the space in the emissive area between the front and the rear substrates, thus improving the sealing efficiency.

In addition, according to the present invention, the size of the discharge cells formed in the non-emissive area vertically to the epoxy molding compound is at least equal to or larger than the width of the epoxy molding compound so that the epoxy molding compound can easily flow during the melting process. Thus, a smooth sealing surface is achieved by means of the epoxy molding compound, thus improving the sealing efficiency.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A plasma display panel, comprising:

a first substrate and a second substrate arranged in opposition to each other, each of the first and the second substrates occupying an emissive area and a non-emissive area surrounding the emissive area and at a periphery of the emissive area;

a plurality of intermediate barrier ribs arranged between the first and the second substrates, the plurality of intermediate barrier ribs having a grating structure and defining a plurality of discharge cells, the plurality of intermediate barrier ribs including a plurality of first barrier ribs extending in a first direction parallel to each other between the first and the second substrates and a plurality of second barrier ribs extending perpendicular to the plurality of first barrier ribs;

a plurality of sustain electrodes including first and second electrodes arranged within the plurality of first barrier ribs and extending parallel to the plurality of first barrier ribs and alternately located about ones of the plurality of discharge cells, the first and the second electrodes being shared by adjacent ones of said plurality of discharge cells;

a plurality of address electrodes arranged on an upper surface of the first substrate and extending parallel to the plurality of second barrier ribs;

a fluorescent layer arranged within the emissive area and on at least one of the first and the second substrates; and an epoxy molding compound arranged within the non-emissive area and adapted to seal a space occupied by the emissive area between the first and the second substrates, wherein ones of the plurality of sustain electrodes being arranged within corresponding ones of the first barrier ribs while extending from an inside of the epoxy molding compound to an outside of the epoxy molding compound.

2. The plasma display panel of claim 1, wherein the plurality of intermediate barrier ribs are arranged within both the emissive area and the non-emissive area, and an interval between adjacent and parallel ones of the plurality of intermediate barrier ribs within the non-emissive area being greater than an interval between adjacent and parallel ones of the plurality of intermediate barrier ribs arranged within the emissive area.

3. The plasma display panel of claim 2, wherein an interval between adjoining and parallel ones of the plurality of intermediate barrier ribs arranged within the non-emissive area and extending parallel to a closest portion of the epoxy molding compound being greater than an interval between adjoining and parallel ones of the plurality of intermediate barrier ribs arranged within the non-emissive area and extending orthogonal to the closest portion of the epoxy molding compound.

4. The plasma display panel of claim 3, wherein the interval between adjoining and parallel ones of the plurality of intermediate barrier ribs arranged within the non-emissive area and extending parallel to a closest portion of the epoxy molding compound being greater than a width of the closest portion of the epoxy molding compound.

5. The plasma display panel of claim 3, wherein the interval between adjoining and parallel ones of the plurality of intermediate barrier ribs arranged at opposite lateral sides of the epoxy molding compound and extending parallel to the epoxy molding compound being greater than a width of the epoxy molding compound.

6. The plasma display panel of claim 1, wherein the plurality of discharge cells comprise:

a plurality of emissive discharge cells arranged within the emissive area; and a plurality of non-emissive discharge cells arranged within the non-emissive area, wherein a length of an edge of each of the plurality of non-emissive discharge cells extending in a direction perpendicular to a closest portion of the epoxy molding compound is greater than a length of an edge of said plurality of emissive discharge cells.

7. The plasma display panel of claim 6, wherein a length of an edge of each of the plurality of non-emissive discharge cells extending perpendicular to a closest portion of the epoxy molding compound is greater than a width of the closest portion of the epoxy molding compound.

8. The plasma display panel of claim 6, wherein a length of an edge of each of the plurality of non-emissive discharge cells extending perpendicular to the epoxy molding compound is at least 5 mm.

9. The plasma display panel of claim 1, wherein the epoxy molding compound comprises glass frit.

10. The plasma display panel of claim 1, wherein the epoxy molding compound has a height equal to or greater than a height of each of the plurality of intermediate barrier ribs.

11. A plasma display panel, comprising:

a first substrate facing a second substrate, each of the first and the second substrates occupying an emissive area and a non-emissive area surrounding the emissive area and at a periphery of the emissive area;

a plurality of intermediate barrier ribs arranged between the first and the second substrates, the plurality of intermediate barrier ribs comprising a plurality of first barrier ribs extending in a first direction and parallel to each other and a plurality of second barrier ribs extending orthogonal to the plurality of first barrier ribs and intersecting the plurality of first barrier ribs;

a plurality of sustain electrodes arranged within the plurality of first barrier ribs;

a plurality of address electrodes arranged on an upper surface of the first substrate and extending parallel to the plurality of second barrier ribs;

a fluorescent layer arranged within the emissive area and on at least one of the first and the second substrates; and an epoxy molding compound arranged within the non-emissive area and adapted to seal a space occupied by the emissive area between the first and the second substrates from an outside, the plurality of sustain electrodes extending through the epoxy molding compound without directly contacting the epoxy molding compound.

12. The plasma display panel of claim 11, the plurality of intermediate barrier ribs being arranged to produce a plurality of emissive discharge cells arranged within said emissive area and a plurality of non-emissive discharge cells arranged within said non emissive area, said epoxy molding compound extending through said non-emissive discharge cells in said non-emissive area.

13. The plasma display panel of claim 12, a length and a width of each of said plurality of non-emissive discharge cells arranged within said non-emission area being equal to a length and a width of each of said plurality of emissive discharge cells arranged within said emissive area.

14. The plasma display panel of claim 12, one of a length and a width of each of said plurality of non-emissive discharge cells arranged within said non-emission area being greater than a length and a width of each of said plurality of emissive discharge cells arranged within said emissive area.

15. The plasma display panel of claim 14, a width of said epoxy molding compound being less than a larger of a width and a length of each of said plurality of non-emissive discharge cells.

16. The plasma display panel of claim 15, the width of the epoxy molding compound being less than 5 mm.

17. The plasma display panel of claim 12, wherein a plurality of rows and columns of non-emissive discharge cells are arranged between an edge of the emissive area and an edge of the substrates.

18. The plasma display panel of claim 11, the epoxy molding compound forming a hermetic seal between both the plurality of intermediate barrier ribs and the first substrate and between the plurality of intermediate barrier ribs and the second substrate.

* * * * *